United States Patent [19]

Brisbon et al.

[11] Patent Number: 4,948,049

[45] Date of Patent: Aug. 14, 1990

[54] RATE CONTROL IN ACCUMULATOR TYPE FUEL INJECTORS

[75] Inventors: Eric S. Brisbon, Ludlow; John B. Cavanaugh, West Springfield; Jeffrey P. DiCarlo, Holyoke; Ross S. Karlson, Wilbraham, all of Mass.

[73] Assignee: AIL Corporation, Columbia, S.C.

[21] Appl. No.: 316,255

[22] Filed: Feb. 24, 1989

[51] Int. Cl.[5] ..... F02M 47/02

[52] U.S. Cl. ..... 239/91; 239/96

[58] Field of Search ..... 239/88, 91, 92, 96

[56] References Cited

U.S. PATENT DOCUMENTS 4,046,112 9/1977 Deckard ..... 234/96
4,129,256 12/1978 Bader, Jr. et al. ..... 239/96
4,605,166 8/1986 Kelly ..... 239/96
4,628,881 12/1986 Beck et al. ..... 239/96

*Primary Examiner*—Andres Kashnikow
*Assistant Examiner*—Karen B. Merritt
*Attorney, Agent, or Firm*—Richard D. Weber

[57] ABSTRACT

The invention provides means for controlling the rate of fuel injection of an accumulator injector of the type employing a pressure amplifying piston assembly. In one form of the invention, the injection rate is controlled by restricting the pressure decay in the amplifier chamber. In another form of the invention, means are provided for delaying the full opening of the injector valve needle after an initial valve opening.

7 Claims, 5 Drawing Sheets

RATE CONTROL IN ACCUMULATOR TYPE FUEL INJECTORS

BACKGROUND OF THE INVENTION

The present invention relates generally to fuel injection equipment for internal combustion engines and relates more particularly to apparatus for controlling the rate of injection in accumulator type injectors.

In an accumulator type fuel injection system, fuel is accumulated under high pressure in the injection nozzles and means are provided for holding the valve needle closed against the pressurized fluid until the proper time to initiate injection. In a typical accumulator system, the additional nozzle closing force which supplements the valve spring force is in the form of a high fuel pressure acting against the upper end of the valve, the release of which permits the valve to open under the influence of the accumulated fuel pressure.

A shortcoming of accumulator type injectors is their characteristic high initial injection rate which drops continuously through the injection interval. This is an undesirable rate characteristic since in most cases, it is desirable to initiate injection at a substantially lower than maximum rate, in some cases even using a pilot injection, to optimize the combustion process.

The present invention is particularly adapted for use with the type of accumulator injector which employs an amplifier piston to hydraulically raise the pressure of the fuel delivered to the accumulator chamber by the rail pump to a high level which might be ten to twenty times the pressure delivered by the pump. An example of such an injection system is shown in U.S. Pat. No. 4,628,881, issued on Dec. 16, 1986. In this system, a fuel supply rail pressure on the order of 1,000 psi is supplied continuously to unit injectors which through appropriate passage and valve means assure a continuous accumulator chamber pressure substantially equal to the rail pressure and well below the pressure required to open the nozzle valve against the closing spring. A double acting solenoid valve when actuated admits rail pressure to the upper end of a pressure amplifying piston assembly which acts to increase the fuel pressure in the accumulator chamber, for example, by a factor of 15. A check valve member disposed concentrically around the upper end of the injection valve needle permits the boosting of the pressure in the accumulator chamber but prevents any backflow when the amplified pressure is released. The upper end of the valve needle extends through the check valve element and is subjected to the amplified pressure, thus supplementing the valve needle closing spring and holding the valve needle closed until the amplified pressure is released.

Upon deenergizing of the solenoid, the double acting valve closes the rod piston inlet to the amplified piston and opens the piston to drain, resulting in a rapid decompression of the fuel pressure above the check valve, thus allowing the valve needle to move sharply upwardly under the force of the accumulated fuel charge. Upon the fuel pressure in the accumulator chamber dropping to the nozzle closing pressure, the nozzle closes under the spring force. This cycle is repeated for each firing sequence of the engine cylinder.

BRIEF SUMMARY OF THE INVENTION

The present invention provides means for controlling the rate of injection of an accumulator injector of the type employing a pressure amplifying piston assembly.

In a preferred embodiment, the invention comprises a modification of the duct connecting the amplifier piston with the drain port to provide an initial piston movement sufficient to allow the valve needle to open, and then move at a controlled rate thereby varying the needle orifice and effectively controlling injection rate. In one form the modification of the amplifier piston outlet duct comprises a conduit within the piston itself which is sequentially aligned with a plurality of passages in the piston chamber wall to vary the rate at which the piston moves. In another embodiment, a snubber valve is provided in the amplifier piston spill duct, the seating of which produces a partial nozzle valve lift and a low initial injection rate. The subsequent spill through the snubber orifice permits full nozzle valve lift and an unrestricted injection rate.

The invention additionally comprises in a further embodiment the modification of the solenoid controlled spill valve which, instead of being fully opened or fully closed is, in the open position, provided with a flow restriction which will limit the spill flow rate and accordingly produce an improved injection rate characteristic.

Additional embodiments of the invention employ means for directly delaying the full opening of the valve needle after an initial valve opening. In one embodiment, this is accomplished by use of a restriction between the accumulated flow chamber and the valve seat. Upon initial valve lift, the volume below the restriction discharges followed by a pause and pressure delay. Leakage past the restriction rebuilds the pressure beneath the valve and lifts the valve needle to clear the restriction.

In another embodiment, the valve needle is divided and the upper portion provided with a bleed orifice. In the charged position of the injector, an hydraulic gap exists between the upper and lower valve portions. When the amplifier pressure is released, the upper valve portion moves quickly against its stop, permitting the lower valve to open partly providing a pilot injection. Fuel is forced from the hydraulic gap through the bleed orifice to slow the injection rate during the initial portion of the injection interval.

It is accordingly a primary object of the present invention to control the rate of injection of an accumulator type injector and particularly an accumulator injector employing an amplifier piston assembly.

Another object of the invention is to provide apparatus for controlling injection rate as described, the embodiments of which are of a relatively simple construction and which can be readily employed with a known type of injector with minimal modifications thereto.

Additional objects and advantages of the invention will be more readily apparent from the following detailed description of embodiments thereof when taken together with the accompanying drawings.

DESCRIPTION OF THE PREFERRED EMBODIMENT

As indicated above, the present invention is an improvement on a conventional form of accumulator injector and particularly that disclosed in U.S. Pat. No. 4,628,881, which is hereby incorporated by reference. Since the present invention involves structural modifications of the unit injector of the injection system disclosed in the patent, only the unit injector disclosed in that patent is shown and described in the present application. Reference may be had to the patent should further details regarding the overall system or its operating characteristics be desired.

Figure 1:
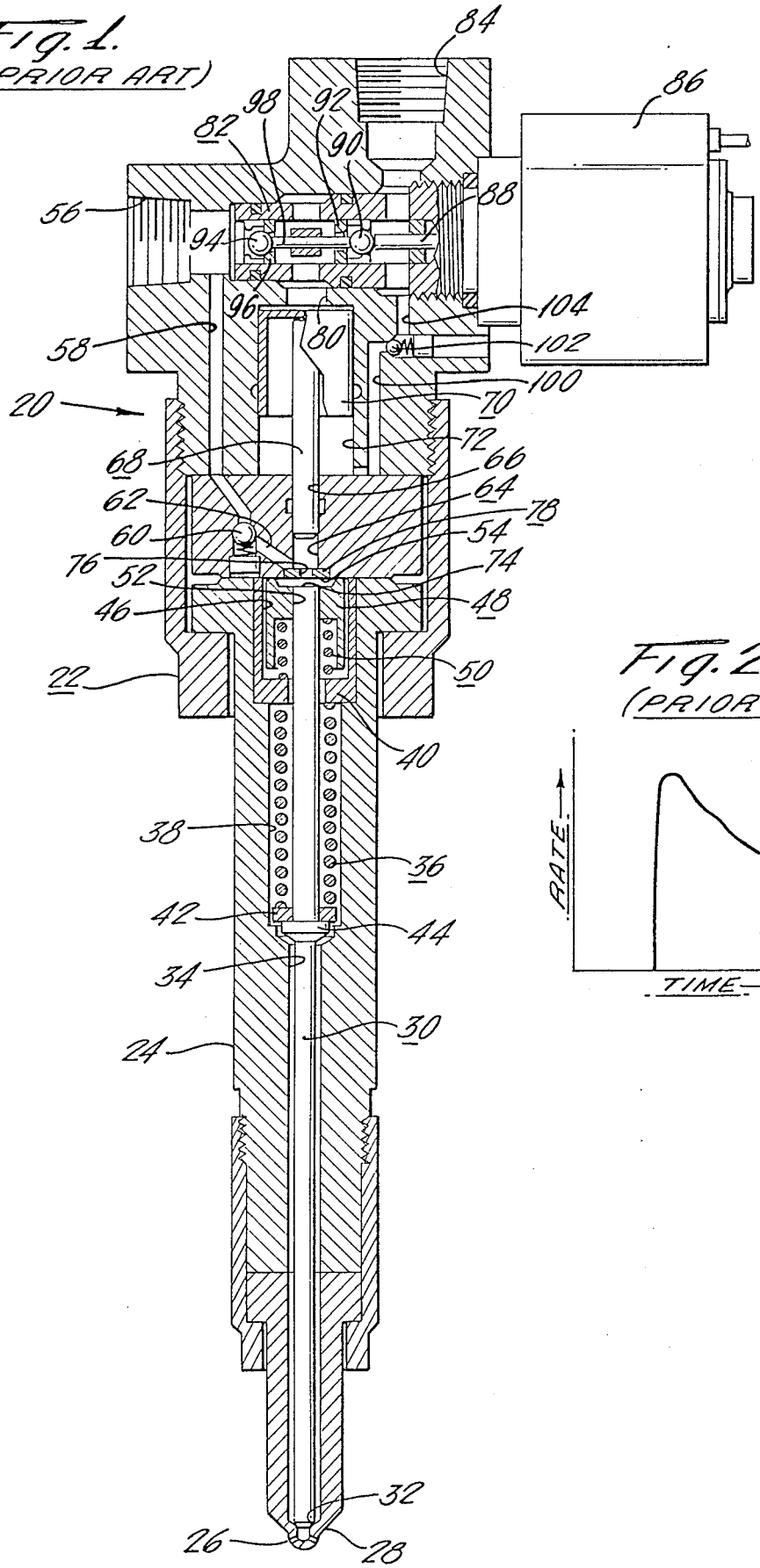
Fig. 1. (PRIOR ART)
FIG. 1 is a sectional view showing a prior art unit injector of the accumulator type for which the present invention is particularly adapted.

FIG. 1 of the present application shows an accumulator type unit injector known in the art and is essentially the injector shown in FIGS. 5*a* and 5*b* of the above patent. In view of the thorough description provided in the above patent and the commercial availability of such injector, the present description will be somewhat general with detail included only as necessary to provide a complete understanding of the present improvements.

Referring to FIG. 1, a unit injector 20 in accordance with the injection includes an injector body assembly 22 comprised of a number of elements which are threadedly secured together in a conventional manner. The lower end of the injector comprises an injector nozzle 24 having a tip 26 which upon mounting of the injector on an engine extends into an engine combustion chamber for delivery of a fine spray of fuel through a plurality of spray orifices 28.

The valve includes a needle valve 30 which at its lower end engages a valve seat 32 to close the fuel passage from the nozzle bore 34 to the orifices 26. The valve 30 is biased downwardly against the seat 32 by a spring 36 disposed in spring chamber 38 and seated at its upper end against a spring seat 40 on the body assembly and at its lower end against a washer 42 supported on shoulder 44 of the valve. A chamber 46 above the spring chamber 38 contains a sleeve-like check valve 48 which is biased upwardly by the compression coil spring 50 seated on the body assembly. The check valve 48 includes a central bore 52 which closely fits around the upper end of the needle valve 30 in sliding relation therewith. The outer annular upper edge of the check valve 48 engages the lower surface 54 of the valve body in the upper limit position of the valve to seal the chamber 46, spring chamber 38 and bore 34, which together comprise the accumulator chamber, from the upper portion of the injector.

Fuel enters the injector through an inlet port 56 at a common rail pressure of approximately 1,000 psi. A conduit 58 in the valve body communicating with the bore 56 permits fuel flow through check valve 60 and passage 62 into an amplifier chamber 64 which comprises the lower part of a bore 66 in the valve body within which is slideably disposed rod 68 of amplifier piston 70 slideably disposed in a larger bore 72.

The upper end 74 of the needle valve 30 is continuously exposed to the fluid pressure in the amplifier chamber 64 by means of a small bore 76 in a washer 78 flush with the injector body surface 54. The washer 78 serves as an upper limit stop for the valve 30.

A duct 80 connects the upper end of the amplifier piston bore 72 with a solenoid controlled valve assembly 82 which selectively connects the amplifier piston with either the rail pressure fuel entering through port 56 or a drain port 84 returning the fuel to the low fuel tank pressure which is essentially atmospheric. The valve assembly 82 includes a solenoid 86, the core of which includes a rod 88 extending into engagement with a ball 90 cooperatively arranged with respect to a valve seat 92 which when opened as shown in FIG. 1 permits a fuel flow from the amplifier piston cylinder through duct 80 and out through the drain port 84. When the drain valve, comprising the ball 90 and valve seat 92, is open, a similar inlet valve comprising ball 94 and valve seat 96 linked thereto by rod 98 is closed, preventing flow from the inlet port 56 into the valve 82. The rail pressure in the port 56 acting against the ball 94 maintains the ball 94, rod 98, ball 90 and rod 88 in contact. The amplifier piston 70 and its piston rod 68 move together, either downwardly under the influence of the rail pressure entering through the duct 80, or upwardly under the influence of the pressure in the amplifier chamber 64, depending on the position of the valve assembly 82. The lower end of the amplifier piston bore 72 is maintained at the low drain pressure by means of the passage 100, ball valve 102 and passage 104 which communicates with the drain port 84.

In operation, with the inlet port 56 connected with a common rail pressure from a fuel supply pump and the drain port 84 connected to the low pressure fuel supply tank, with the solenoid valve in the position shown in FIG. 1, fuel from the inlet port 56 passes through the conduit 58, check valve 60 and passage 62 into the amplifier chamber 64, thence through bore 76 in washer 78 and past the check valve 48 into the chamber 46, thereby filling and pressurizing the chamber 46, spring chamber 38 and the bore 34, which collectively comprise the accumulator chamber. Actuation of the solenoid 86 shifts the valve assembly 82 to permit the rail pressure to enter through duct 80 into the amplifier piston chamber, thereby driving the piston rod 68 downwardly and compressing the fuel in the amplifier chamber 64 as well as the accumulator chamber to a high pressure, for example on the order of 15,000–20,000 psi. The fuel charge in the accumulator chamber is then at its injection pressure and ready for injection, but the valve needle 30 will not open since the force of the spring 36 is augmented by the pressure in the amplifier chamber 64 acting against the upper end 74 of the valve.

To initiate injection, the solenoid valve 86 is deactivated, permitting the valve assembly 82 to shift to the right under the influence of the pressure in the inlet port bearing on valve ball 94. This opens the amplifier piston 80 to drain, permitting the amplifier piston and rod 68 to move rapidly upwardly, relieving the pressure in the amplifier chamber 64 acting on the upper end 74 of the valve needle 30. The valve needle then opens quickly under the influence of the high pressure fuel in the accumulator chamber, the check valve 48 being held closed under the influence of the spring 50 and the differential pressure bearing thereagainst. The fuel then passes from the nozzle bore 34 out through the spray passages 28 into the engine combustion chamber.

Figure 2:
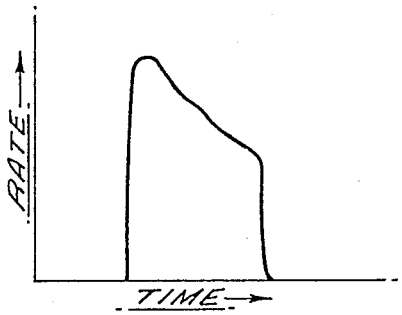
Fig. 2. (PRIOR ART)
FIG. 2 is a diagram showing the injection rate characteristic of a conventional accumulator injector such as that shown in FIG. 1.

In FIG. 2, the rate of fuel injection is shown versus time and it may be seen that it is characteristic of an accumulator type injector to produce an initial maximum rate of flow which drops off rather sharply until the pressure drops below the spring generated nozzle closing pressure, at which point the nozzle closes and injection ends. It is the primary object of the present invention to shape this rate curve in a manner more conducive to efficient combustion since it is generally desirable to initiate injection at a rate well below the maximum injection rate both for the purposes of providing complete combustion and minimizing the generation of pollutants. The following embodiments of the invention are each carried out by a relatively minor modification of the prior art injector structure described above and it will be seen that a variety of rate curves can be achieved utilizing the modifications of the invention.

Figure 3:
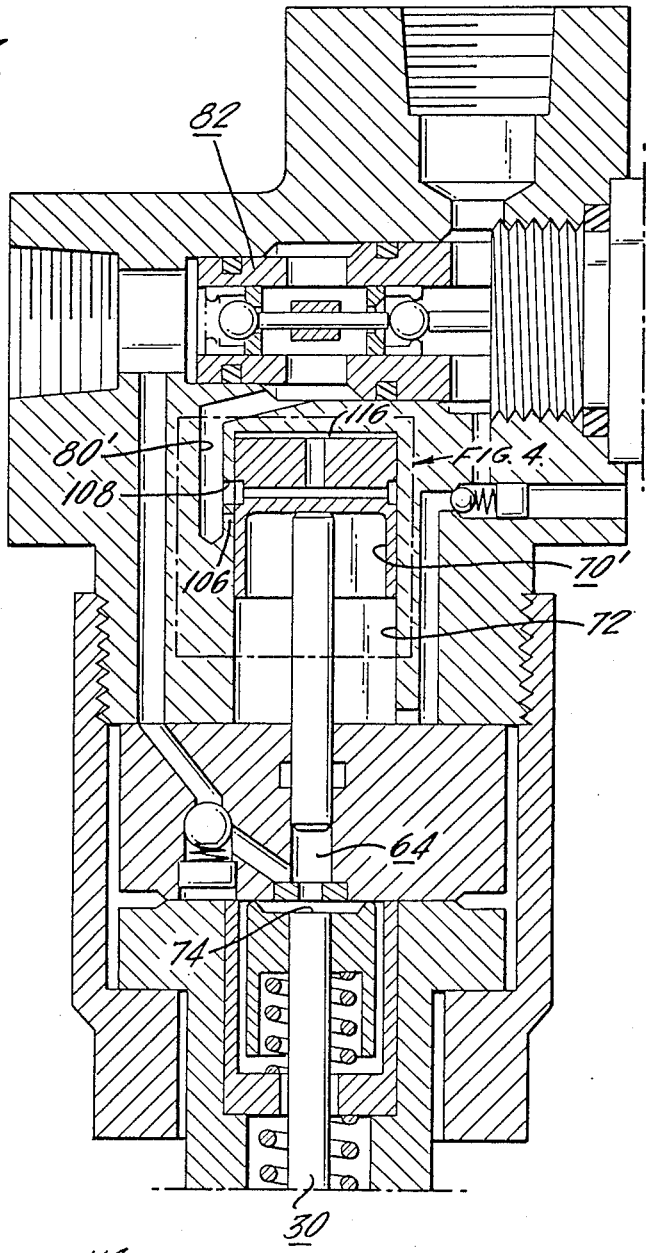
FIG. 3 is an enlarged view of the upper portion of the injector shown in FIG. 1 modified in accordance with a first embodiment of the present invention to provide control of the fuel injection rate.
Figure 4:
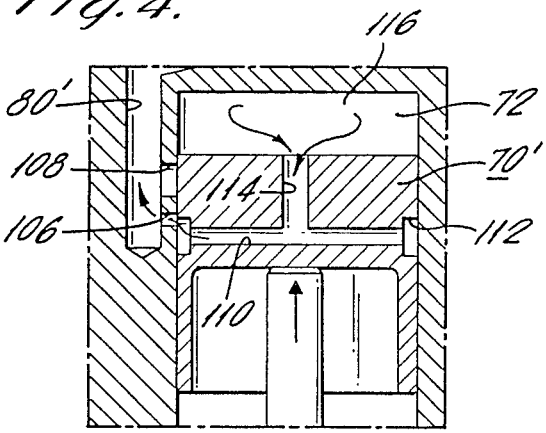
FIG. 4 is an enlarged view of the area of FIG. 3 enclosed in broken lines.

A first embodiment of the invention is shown in FIGS. 3 and 4. FIG. 3 is substantially identical to the upper portion of the injector shown in FIG. 1 but showing a modification of the amplifier piston and the duct connecting the amplifier piston with the valve 82. In this embodiment, the duct 80' extends from the valve assembly 82 along side of and spaced from the amplifier cylinder 72 and communicates with the cylinder by means of a smaller lower port 106 and a larger upper port 108. The amplifier piston 70' is modified to include a transverse passage 110 which communicates with an annulus 112 in the side wall thereof. The passage 110 intersects a central longitudinal passage 114 which opens into the closed upper end chamber 116 of the cylinder 72.

In FIG. 4, the amplifier piston 70' is shown in its lowermost position just after the opening of the valve assembly 82 to drain fuel from the amplifier valve assembly. At this point, the annulus 112 is partly opened to the duct port 106 and pressure relief takes place at a slow initial rate due to the small size of the port 106. By restricting the rate of movement of the amplifier piston 70' upwardly, the pressure in the amplifier chamber 64 and hence in the accumulator chamber is relieved at a rate slower than that of the injector of FIG. 1, hence changing the rate of opening of the valve needle and the rate of fuel injection. The initial fuel flow from the amplifier chamber 116 through the passages 114, 110 and annulus 112 into the small duct 106 produces a small pilot injection and as the annulus passes between the ports 106 and 108, a diminution in the rate of fuel delivery as shown diagrammatically in FIG. 5. The full fuel delivery rate is achieved when the annulus 112 moves opposite the port 108, which position is shown in FIG. 3.

Figure 5:
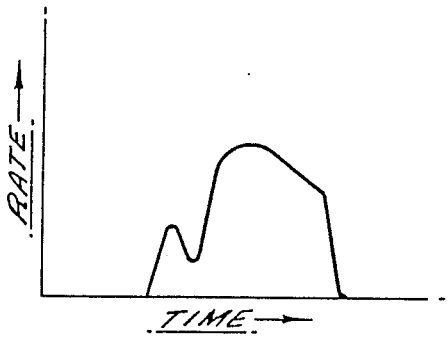
FIG. 5 is a diagram showing the injection rate characteristic of the modified injector of FIGS. 3 and 4.

The embodiment of FIGS. 3 and 4 functions essentially by control of the decay of pressure in the amplifier chamber 64 and a consequent control of the rate of opening of the needle valve 30 in view of the exposure of the end 74 of the valve needle to the amplifier chamber pressure. This decay is governed by the rate of dumping of the fuel from the amplifier chamber 116 by varying the spill flow area to the drain duct. By selection of the number, size and shape of the ports connecting the amplifier cylinder 72 with the duct 80', the desired injection rate can be controlled as desired, and the rate curve of FIG. 5 is simply an example of the type of rate control that can be achieved by this embodiment.

Figure 6:
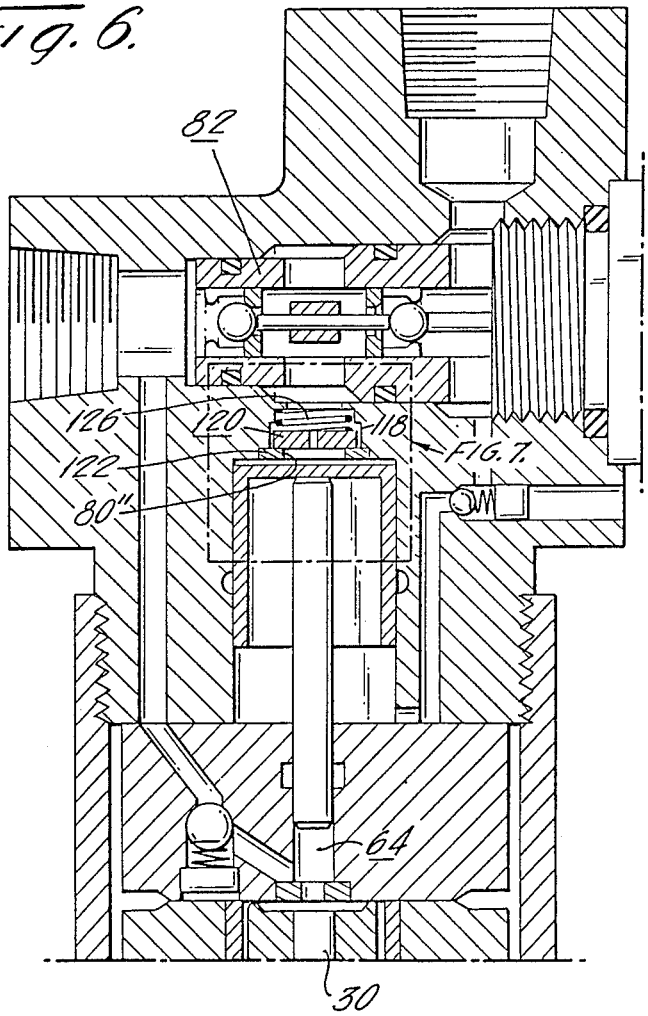
FIG. 6 is an enlarged view of the upper end of the injector shown in FIG. 1 modified in accordance with a second embodiment of the present invention to provide control of the injection rate.
Figure 7:
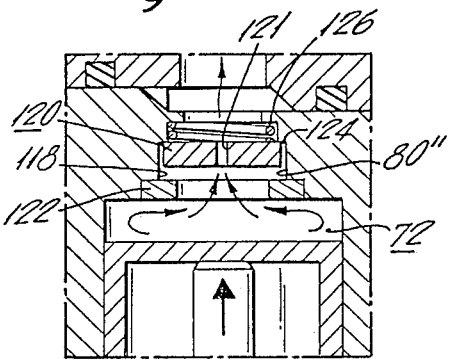
FIG. 7 is an enlarged view of the area enclosed in broken lines in FIG. 6.

A second embodiment of the invention as shown in FIGS. 6 and 7 utilizes this same general concept to control injection rate. In this embodiment, the injector as shown in FIG. 1 is modified to incorporate a snubber valve within the amplifier duct.

As shown most clearly in the enlarged of FIG. 7, in this embodiment the amplifier duct 80'' extends from the upper end of the amplifier cylinder 72 directly into the valve assembly 82. The duct 80'' is enlarged to provide a cylindrical snubber valve chamber 118 within which the snubber valve 120 is disposed. The valve 120 comprises a disk of slightly smaller diameter than the chamber 118 with a bleed passage 121 therein and having an axial dimension somewhat less than the chamber 118 so that it may move from a lower position as shown in FIG. 6, wherein it rests against an annular spring 122, to an upper position shown in FIG. 7 wherein it engages a shoulder 124. A compression coil spring 126 biases the snubber valve toward the lower limit position shown in FIG. 6.

In FIG. 6, the injector is shown following the injection cycle and prior to the recharging and amplifying of the charge. Upon actuation of the solenoid valve 82, the flow from the inlet duct 56 through the valve assembly 82 through duct 80'' takes place through the bleed passage 121 in the snubber valve 120. Although amplification of the fuel charge in the accumulator chamber will take place somewhat more slowly than usual, this is unimportant since a relatively large amount of time is available for this function.

Upon opening of the relief port to relieve pressure in the amplifier cylinder chamber, an initial surge of pressure relief is provided by movement of the snubber valve from its lower position to its upper position shown in FIG. 7 into engagement with the shoulder 126. This movement is sufficient to produce a consequent pressure decay in the amplifier chamber 64 and permit the valve to open but not fully. Subsequent pressure decay takes place at a measured rate dependent on the size of the bleed passage 121, and the maximum injection rate is gradually reached as shown in the rate versus time diagram of FIG. 8.

Figure 8:
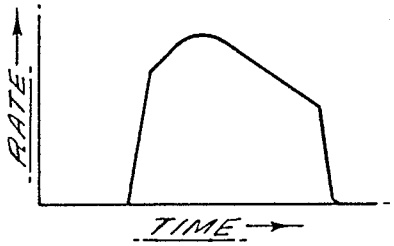
FIG. 8 is a diagram showing the injection rate characteristic of the injector with the modification shown in FIGS. 6 and 7.
Figure 9:
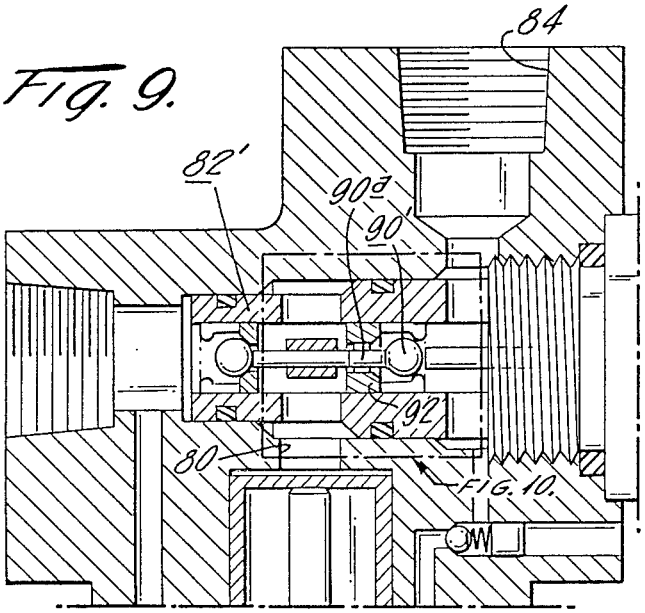
FIG 9 is an enlarged view showing the valve portion of the injector of FIG. 1 modified in accordance with a third embodiment of the invention.
Figure 10:
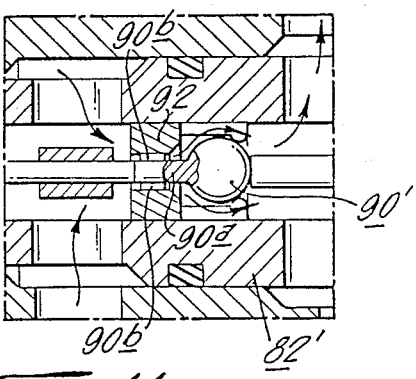
FIG. 10 is an enlarged sectional view of the area enclosed in broken lines in FIG. 9.
Figure 11:
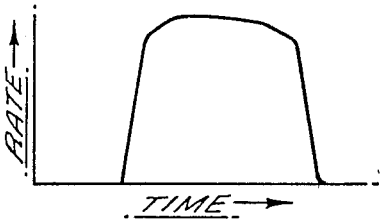
FIG. 11 is a diagram showing the injection rate characteristic of the injector with the modification of FIGS. 9 and 10.

In a third embodiment of the invention shown in FIGS. 8 and 9, the same concept utilized in the two previous embodiments of the invention is employed, namely to restrict the draining of flow from the amplifier piston assembly and thereby control the pressure decay in the amplifier chamber and hence the rate at which the needle valve opens. In the embodiment of FIGS. 9 and 10, the valve assembly 82 is modified to a minor degree by providing a restriction in the drain valve comprising the ball 90 and seat 92. Specifically, the ball 90' of the modified valve assembly 82' includes a stem **90*a* which is disposed within the bore of the valve seat 92 and which includes a plurality of spaced flutes 90*b* thereon which slidingly guide the stem portion within the valve seat bore. The flutes serve both to align the ball 90' as well as to provide a predetermined degree of restriction to the valve seat and accordingly a controlled rate of decay of pressure in the accumulator chamber 64 and a consequently regulated rise of the valve needle 30. As shown in FIG. 11**, the rate curve using this embodiment may be such as to provide a relatively constant rate of injection over the course of the injection interval in contrast to the rapidly dropping rate characteristic of the prior art.

In the operation of the embodiment of FIGS. 9 and 10, the ball 90' in the closed position seats in the valve seat 92 in the usual fashion. When the valve opens, the valve stem **90*a* and the flutes 90*b* are sized to provide a sufficient restriction in the valve seat so as to limit the flow rate of fuel from the amplifier cylinder duct 80 to the drain port 84**. The advantage of this embodiment is its simplicity and economy in that only a minor element of the injector valve need be modified, and this modification is extremely simple and inexpensive.

Figure 12:
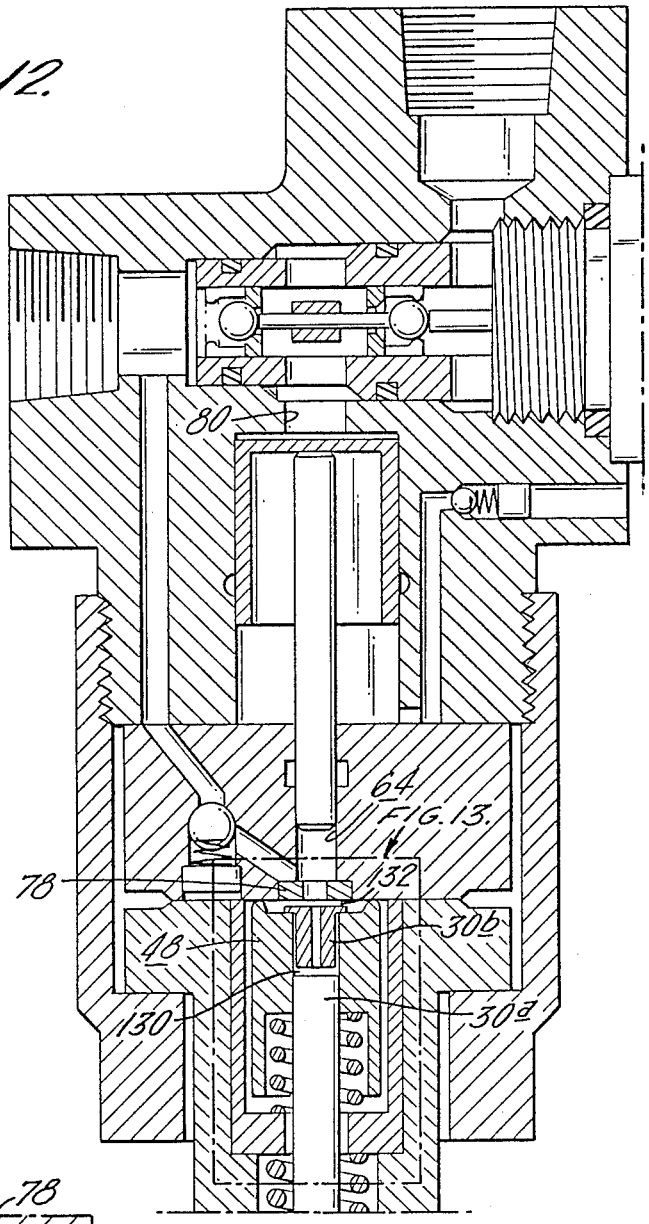
FIG. 12 is an enlarged view of the upper end of the injector of FIG. 1 modified in accordance with a fourth embodiment of the invention.
Figure 13:
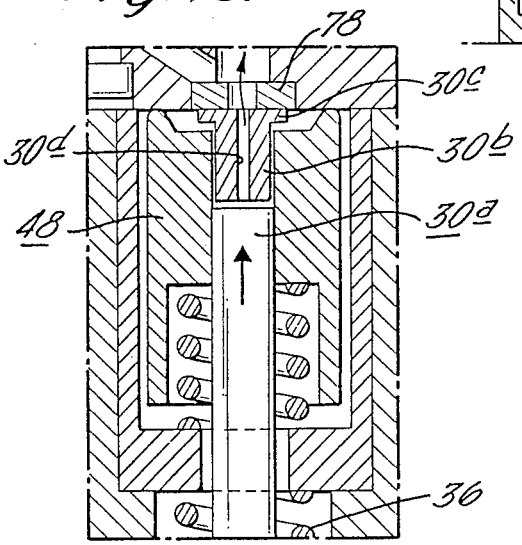
FIG. 13 is an enlarged view of the area of FIG. 12 enclosed in broken lines.

A fourth embodiment of the invention is shown in FIGS. 12 and 13 and differs from the previously described three embodiments in the sense that the amplifier piston is allowed to open rapidly, thus permitting the pressure in the amplifier chamber 64 to quickly decay. The opening of the nozzle valve is controlled in this embodiment by modifying the exposure of the upper end of the needle valve to the accumulator chamber.

Specifically, the valve needle is divided into a lower valve **30*a* and an upper valve 30*b*, the upper valve 30*b* being relatively short in relation to the lower valve 30*a*. The upper valve 30*b* includes an annular flange 30*c* extending radially outwardly around its upper end, which flange seats on the check valve 48 in the lowered position of the valve members as shown in FIG. 12. A central bleed passage 30*d* extends axially through the upper valve 30*b*. With the lower valve 38 seated by the spring 36, an hydraulic gap 130 exists between the upper end of the lower valve 30*a* and the lower end of the upper valve 30*b*. In addition, with the upper valve 30*b* seated on the check valve 48, a space 132 exists between the upper end of the upper valve 30*b* and the stop washer 78**.

Figure 14:
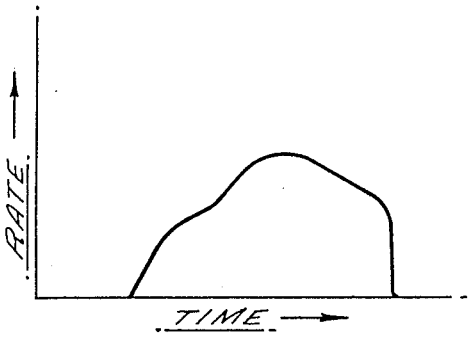
FIG. 14 is a diagram showing the injection characteristic of the injector modified in accordance with the embodiment shown in FIGS. 12 and 13.

In operation, during and following charging of the accumulator chamber, the upper and lower valve elements are in the position shown in FIG. 12, although the upper valve element will move with the movement of the check valve 48 during charging and amplification of the charge in the accumulator chamber. Upon the rapid relief of pressure in the amplifier chamber 64, the lower valve element **30*a* and upper valve element 30*b* will rapidly move upwardly separated by the hydraulic gap 130 to permit the lower valve element 30*a* to lift off its seat and initiate injection. When the upper valve element engages the washer 78, the lower valve 30*a* will rise at a more gradual rate since the fuel in the hydraulic gap 130 must pass through the bleed passage 30*d* to permit the complete opening of the valve. As shown diagrammatically in FIG. 14, the maximum injection rate can be delayed utilizing this embodiment until approximately the midpoint of the injection interval. The operation of this embodiment is not dissimilar from that of FIGS. 6 and 7 in the sense that the upper valve 30*b*** acts much like the snubber valve of the previously described embodiment.

Figure 15:
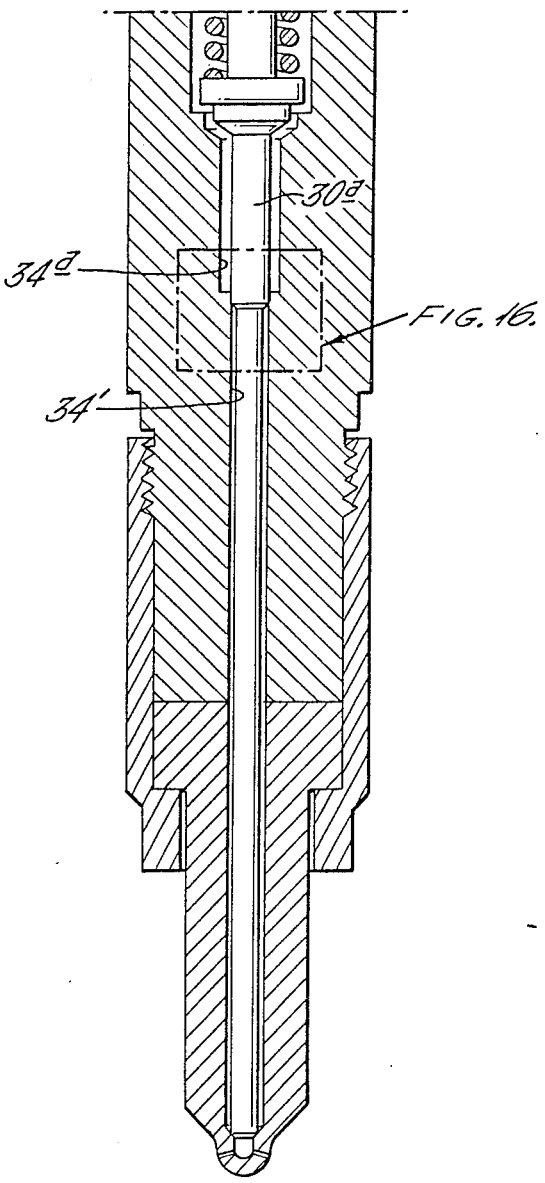
FIG. 15 is an enlarged view of the lower end of the injector shown in FIG. 1 modified in accordance with a fifth embodiment of the invention.
Figure 16:
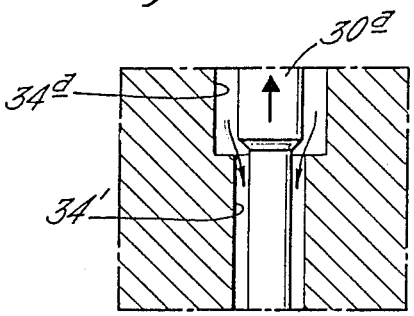
FIG. 16 is an enlarged view of the portion of FIG. 15 enclosed in broken lines.
Figure 17:
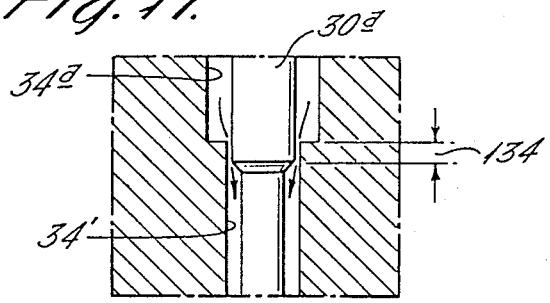
FIG. 17 is a view similar to FIG. 16 showing the valve needle in a different position.

A fifth embodiment of the invention is shown in FIGS. 15–17 and is similar to the preceding embodiment in the sense that it involves a modification of the needle valve 30 with a resultant control of the rate of opening of the valve. In this embodiment, a close fit between the valve and the nozzle body at some distance of the valve needle from the valve seat effectively divides the accumulator chamber into two portions. Upon initial valve lift, the volume below the restriction discharges through the spray passages, followed by a slow rebuilding of the pressure until the valve lifts to clear the restriction. The remainder of the accumulated charge then is injected at a normal declining rate.

Specifically, as shown most clearly in the enlarged view of FIG. 17, an enlarged diameter upper portion **30*a* of the needle valve 30 is disposed primarily in an enlarged bore portion 34*a* but extends downwardly a short distance 134 into the normal size bore 34' in a close fitting relationship therewith. The clearance at this overlapped portion provides a restriction but is sufficient to allow a bleed flow of fuel between the overlapped valve portion 30*a* and the valve bore 34'**.

Figure 18:
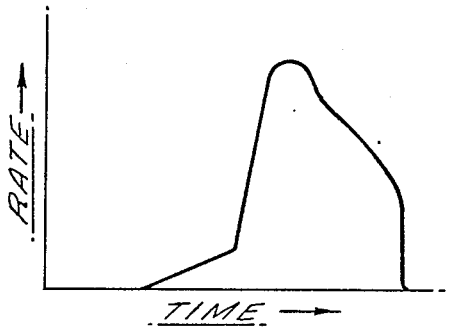
FIG. 18 is a diagram showing the injection characteristic of a injector modified in accordance with the embodiment shown in FIGS. 15–17.

Prior to injection, the amplified fuel pressure is the same above and below the restriction and hence the valve will open promptly upon relief of pressure in the amplifier chamber 64. However, the flow through the restriction between the enlarged needle valve portion **30*a* and the bore 34' will result in a slow increase in flow rate until the restriction is cleared when the portion 30*a* is entirely within the enlarged bore 34*a* shown in FIG. 16. This results in the rate curve shown diagrammatically in FIG. 18 wherein a slow initial injection rate rises rapidly to a peak rate, following which the injection rate falls off as in the conventional accumulator injector, as shown for example in FIG. 2**.

Manifestly, changes in details of construction can be effected by those skilled in the art without departing from the invention,

We claim:

1. An accumulator injector comprising an injection nozzle having a valve spring-biased toward a closed position, an accumulator chamber for connection with a source of pressurized fuel, said accumulator chamber communicating with said nozzle with the pressurized fuel therein acting to urge said valve toward an open position, an amplifier chamber in communication with the source of pressurized fuel, the end of said valve being subjected to the pressure in said amplifier chamber, an amplifier piston assembly for boosting the pressure in said amplifier chamber and in said accumulator chamber, a duct for introducing a pressurized fluid into and draining said fluid from said amplifier piston assembly, and valve means associated with said duct for controlling fluid flow through said duct into and out of said amplifier piston assembly to selectively effect either a boosting of the pressure in said amplifier chamber and said accumulator chamber to charge said accumulator chamber with high pressure fuel, or a relief of the pressure in said amplifier chamber, thereby permitting said valve to open under the influence of the pressurized fuel in said accumulator chamber, and means for controlling the rate of injection through said nozzle, said latter means comprising means for restricting the fluid flow from said amplifier chamber to thereby restrict the pressure decay in said amplifier chamber.

2. The invention as claimed in claim 1, wherein said means for restricting the fluid flow from said amplifier chamber comprises a plurality of ports connecting said duct with the amplifier piston cylinder, and passage means within said amplifier piston sequentially communicating with said ports.

3. The invention as claimed, in claim 1, wherein said means for restricting the fluid flow from said amplifier chamber comprises a snubber valve in said duct.

4. The invention as claimed in claim 3, wherein said snubber valve comprises a spring biasing said snubber valve toward said amplifier piston assembly.

5. The invention as claimed in claim 1, wherein said means for restricting the fluid flow from said amplifier chamber comprises a restriction in said valve means for restricting the flow of fluid from said duct during draining of the amplifier chamber.

6. An accumulator injector comprising an injection nozzle having a valve spring-biassed toward a closed position, an accumulator chamber for connection with a source of pressurized fuel, said accumulator chamber communicating with said nozzle with the pressurized fuel therein acting to urge said valve toward an open position, an amplifier chamber in communication with the source of pressurized fuel, the end of said valve being subjected to the pressure in said amplifier chamber, an amplifier piston assembly for boosting the pressure in said amplifier chamber and in said accumulator chamber, a duct for introducing a pressurized fluid into and draining said fluid from said amplifier piston assembly, and valve means associated with said duct for controlling fluid flow through said duct into and out of said amplifier piston assembly to selectively effect either a boosting of the pressure in said amplifier chamber and said accumulator chamber to charge said accumulator chamber with high pressure fuel, or a relief of the pressure in said amplifier chamber, thereby permitting said valve to open under the influence of the pressurized fuel in said accumulator chamber, and means for controlling the rate of injection through said nozzle, said latter means comprising the division of said valve into upper and lower valve portions having an hydraulic gap therebetween in the closed position of said valve, and a bleed passage in the upper valve portion communicating with said amplifier chamber.

7. An accumulator injector comprising an injection nozzle having a valve spring-biassed toward a closed position, an accumulator chamber for connection with a source of pressurized fuel, said accumulator chamber communicating with said nozzle with the pressurized fuel therein acting to urge said valve toward an open position, an amplifier chamber in communication with the source of pressurized fuel, the end of said valve being subjected to the pressure in said amplifier chamber, an amplifier piston assembly for boosting the pressure in said amplifier chamber and in said accumulator chamber, a duct for introducing a pressurized fluid into and draining said fluid from said amplifier piston assembly, and valve means associated with said duct for controlling fluid flow through said duct into and out of said amplifier piston assembly to selectively effect either a boosting of the pressure in said amplifier chamber and said accumulator chamber to charge said accumulator chamber with high pressure fuel, or a relief of the pressure in said amplifier chamber, thereby permitting said valve to open under the influence of the pressurized fuel in said accumulator chamber, and means for controlling the rate of injection through said nozzle, said latter means comprising a restriction dividing said accumulator chamber into two volumes, said restriction being removed upon full opening of the valve.

* * * * *